US009016220B2

(12) United States Patent
Gariepy et al.

(10) Patent No.: US 9,016,220 B2
(45) Date of Patent: Apr. 28, 2015

(54) VARIABLE GEOMETRY WATER VESSEL

(71) Applicant: Clearpath Robotics, Inc., Kitchener (CA)

(72) Inventors: Ryan Christopher Gariepy, Kitchener (CA); Patrick William Martinson, Waterloo (CA); Mark Julian Podbevsek, Brampton (CA); Matthew Allen Rendall, Waterloo (CA); Todd Willick, Edmonton (CA)

(73) Assignee: Clearpath Robotics, Inc., Kitchener (CA)

( * ) Notice: Subject to any disclaimer, the term of this patent is extended or adjusted under 35 U.S.C. 154(b) by 0 days.

(21) Appl. No.: 14/027,790

(22) Filed: Sep. 16, 2013

(65) Prior Publication Data

US 2014/0080367 A1 Mar. 20, 2014

Related U.S. Application Data

(60) Provisional application No. 61/743,958, filed on Sep. 17, 2012.

(51) Int. Cl.

| | |
|---|---|
| ***B63B 7/00*** | (2006.01) |
| ***B63H 11/01*** | (2006.01) |
| ***B63H 11/00*** | (2006.01) |
| ***B63H 21/17*** | (2006.01) |
| ***B63B 5/24*** | (2006.01) |
| ***B63B 7/02*** | (2006.01) |
| *B63B 3/08* | (2006.01) |
| *B63B 35/00* | (2006.01) |

(52) U.S. Cl.

CPC *B63B 7/00* (2013.01); *B63H 11/01* (2013.01); *B63H 11/00* (2013.01); *B63H 21/17* (2013.01); *B63B 5/24* (2013.01); *B63B 7/02* (2013.01); *B63B 2003/085* (2013.01); *B63B 2007/003* (2013.01); *B63B 2035/008* (2013.01); *B63H 2011/008* (2013.01)

(58) Field of Classification Search

CPC ..... B63B 7/00; B63H 11/01
USPC ..... 114/352–354, 61.1–61.2
See application file for complete search history.

(56) References Cited

U.S. PATENT DOCUMENTS

| | | | | | |
|---|---|---|---|---|---|
| 3,541,987 | A | * | 11/1970 | William | 114/61.16 |
| 3,937,166 | A | * | 2/1976 | Lindsay | 114/123 |
| 3,981,259 | A | * | 9/1976 | Harper, Jr. | 114/61.15 |
| 5,235,925 | A | * | 8/1993 | Farrier | 114/61.16 |
| 5,237,947 | A | * | 8/1993 | Manning | 114/61.16 |
| 5,265,550 | A | * | 11/1993 | Harper, Jr. | 114/61.16 |
| 5,277,142 | A | * | 1/1994 | Connor | 114/61.16 |

(Continued)

*Primary Examiner* — Lars A Olson
*Assistant Examiner* — Jovon Hayes
(74) *Attorney, Agent, or Firm* — Perry + Currier Inc.

(57) ABSTRACT

A water vessel having variable geometry is described. The water vessel comprises: a frame; a plurality of hulls coupled to the frame, each one of the plurality of hulls coupled to the frame by a folding mechanism and configured to move, relative to the frame, between a deployed configuration and a stowed configuration in which at least one dimension of the water vessel is reduced in respect of the deployed configuration; a plurality of thruster assemblies configured to provide thrust to the water vessel, each one of the plurality of thruster assemblies being coupled to a respective one of the plurality of hulls; and a protective device coupled to a respective one of the plurality of thruster assemblies, the protective device for preventing intake of foreign objects into the respective one of the plurality of thruster assemblies.

20 Claims, 9 Drawing Sheets

(56) References Cited

U.S. PATENT DOCUMENTS

| | | | | |
|---|---|---|---|---|
| 5,282,763 | A * | 2/1994 | Dixon | 440/42 |
| 5,522,339 | A * | 6/1996 | Pelly | 114/354 |
| 6,089,173 | A * | 7/2000 | Lande | 114/39.23 |
| 6,095,079 | A * | 8/2000 | Smidt | 114/353 |
| 6,327,994 | B1 * | 12/2001 | Labrador | 114/382 |
| 6,581,537 | B2 * | 6/2003 | McBride et al. | 114/312 |
| 6,640,737 | B2 * | 11/2003 | Chacon | 114/61.15 |
| 6,698,375 | B2 * | 3/2004 | Delfosse | 114/265 |
| 6,725,798 | B1 * | 4/2004 | Hill | 114/347 |
| 6,823,809 | B2 * | 11/2004 | Hey | 114/45 |
| 6,990,915 | B2 * | 1/2006 | Smith | 114/61.16 |
| 7,225,748 | B2 * | 6/2007 | Caspi et al. | 114/61.16 |
| 7,234,405 | B2 * | 6/2007 | Hodgson | 114/61.15 |
| 7,278,364 | B2 * | 10/2007 | Root, Jr. | 114/61.15 |
| 7,628,115 | B2 * | 12/2009 | Thompson | 114/61.18 |
| 7,856,938 | B2 * | 12/2010 | Marion et al. | 114/312 |
| 8,408,155 | B2 * | 4/2013 | Sancoff et al. | 114/282 |
| 8,640,640 | B2 * | 2/2014 | Conti et al. | 114/61.15 |
| 8,656,856 | B1 * | 2/2014 | Morrow | 114/354 |
| 2002/0033127 | A1 * | 3/2002 | Barrett | 114/61.15 |
| 2003/0033967 | A1 * | 2/2003 | Hayman, III | 114/61.15 |
| 2005/0268833 | A1 * | 12/2005 | Conrad | 114/55.5 |
| 2010/0138084 | A1 * | 6/2010 | Pereira | 701/21 |
| 2011/0247538 | A1 * | 10/2011 | Gimpel et al. | 114/61.1 |
| 2013/0081565 | A1 * | 4/2013 | Kormann | 114/282 |
| 2014/0080367 | A1 * | 3/2014 | Gariepy et al. | 440/6 |

* cited by examiner

VARIABLE GEOMETRY WATER VESSEL

FIELD

The specification relates generally to marine vessel design, and specifically to a variable geometry water vessel which may be deployed in shallow water.

BACKGROUND

The ability to quickly and safely deploy equipment above or below the surface of a body of water can have a positive impact on a variety of tasks, including bathymetric surveys, water quality monitoring, search and rescue, surveillance, civil infrastructure inspection, and underwater vehicle deployment. Recent advances have allowed marine vessels outfitted with suitable equipment to be remotely or automatically controlled with no need for a human presence.

It is therefore desirable to design water vessels which are as small as possible, such that they can be easily launched, retrieved, and transported. As the water vessels may be unmanned, they should also be provided with systems which allow them to resist concerns such as propeller fouling. Likewise, in the case of critical system failure, a means for retrieval would also be desirable. From an operational perspective, it is advantageous for a water vessel to have minimal draught to allow for near-shore operation, and to be configured to enhance vessel stability. A water vessel intended for use as an equipment platform should also provide features to allow equipment to be mounted easily with minor or no hull modifications.

SUMMARY

According to one implementation, there is provided a water vessel comprising: a frame; a plurality of hulls coupled to the frame, each one of the plurality of hulls coupled to the frame by a folding mechanism and configured to move, relative to the frame, between a deployed configuration and a stowed configuration in which at least one dimension of the water vessel is reduced in respect of the deployed configuration; a plurality of thruster assemblies configured to provide thrust to the water vessel, each one of the plurality of thruster assemblies being coupled to a respective one of the plurality of hulls; and a protective device coupled to a respective one of the plurality of thruster assemblies, the protective device for preventing intake of foreign objects into the respective one of the plurality of thruster assemblies.

According to a related implementation, the water vessel further comprises a carrying mechanism coupled to the frame for transporting the water vessel by securing the water vessel to the one or more of an operator, another vessel and a vehicle. According to another related implementation, the carrying mechanism comprises one or more of a carrying strap, a carrying frame and a carrying handle. According to another related implementation, the carrying mechanism is detachable.

According to another implementation, the plurality of thruster assemblies are configured to provide differential thrust to the water vessel.

According to another implementation, the folding mechanism is configured to rotate at least one of the plurality of hulls relative to the frame.

According to another implementation, folding mechanism comprises one or more of: a spring, an electrical actuator and a combined electromechanical system.

According to another implementation, the protective device comprises a grate.

According to another implementation, the plurality of thruster assemblies are configured to provide reverse thrust to the low draught water vessel. According to a related implementation, the water vessel further comprises a diverter plate coupled to at least one of the plurality of thruster assemblies.

According to another implementation, the plurality of thruster assemblies are driven by one or more of: a direct current (DC) motor, an internal combustion engine and a gas turbine.

According to another implementation, the water vessel further comprises an onboard control and monitoring system. According to a related implementation, the onboard control and monitoring system is configured to provide remote control and monitoring of the water vessel.

According to another implementation, the water vessel further comprises a communication system.

According to another implementation, the water vessel further comprises one or more of: a power button, a communications antenna, a camera and a Global Positioning System (GPS).

According to another implementation, the water vessel further comprises at least one signalling device. According to a related implementation, the at least one signalling device comprises one or more of: a navigation light and a flag.

According to another implementation, the water vessel further comprises a sensing system having one or more of a camera and a Global Positioning System (GPS).

According to another implementation, the water vessel is battery-powered.

According to another implementation, the water vessel further comprises a dorsal mounting surface removably coupled to the frame.

BRIEF DESCRIPTIONS OF THE DRAWINGS

For a better understanding of the various implementations described herein and to show more clearly how they may be carried into effect, reference will now be made, by way of example only, to the accompanying drawings in which.

Figure 1:
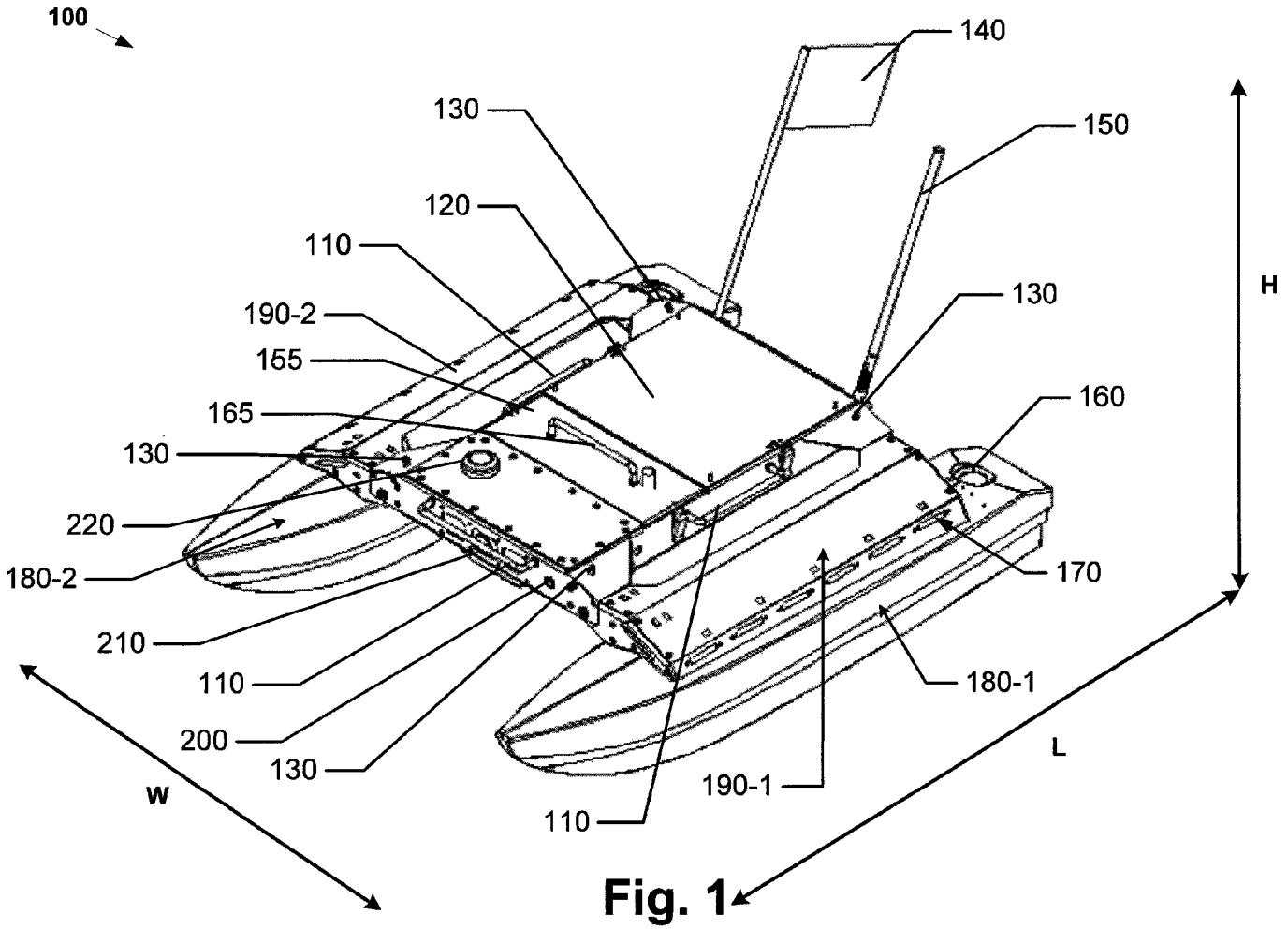
FIG. 1 depicts a water vessel with the hulls in a deployed configuration, according to non-limiting implementations.
Figure 3B:
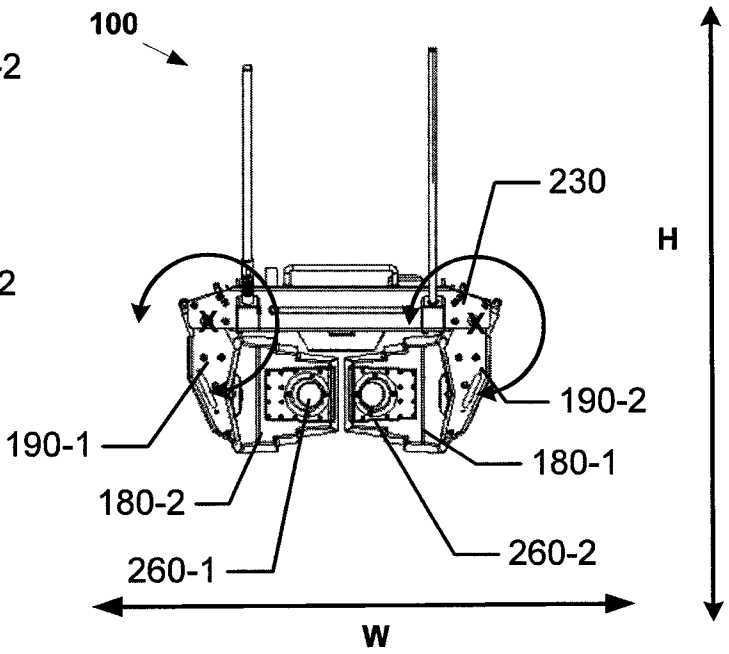
Figure 3A:
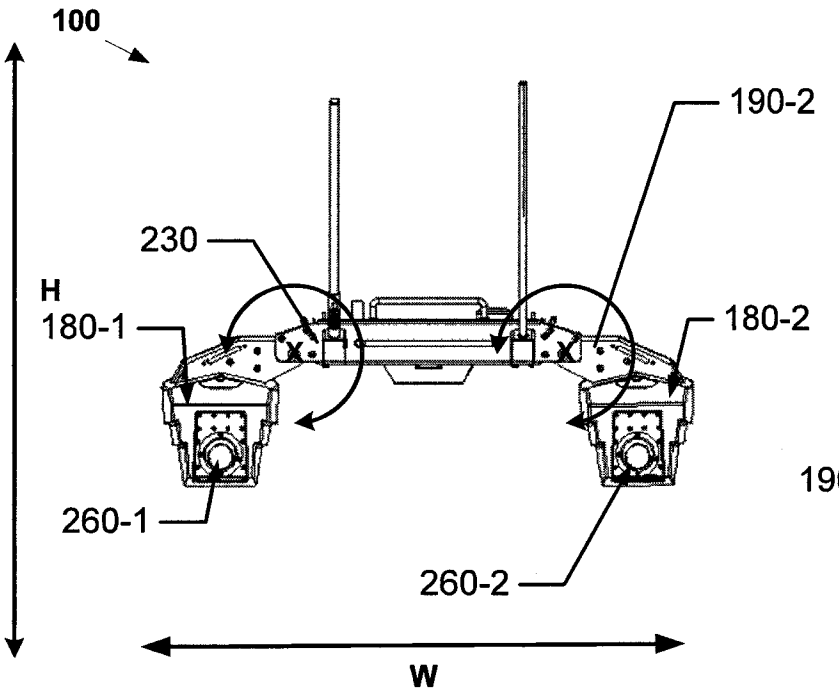
Figure 4:
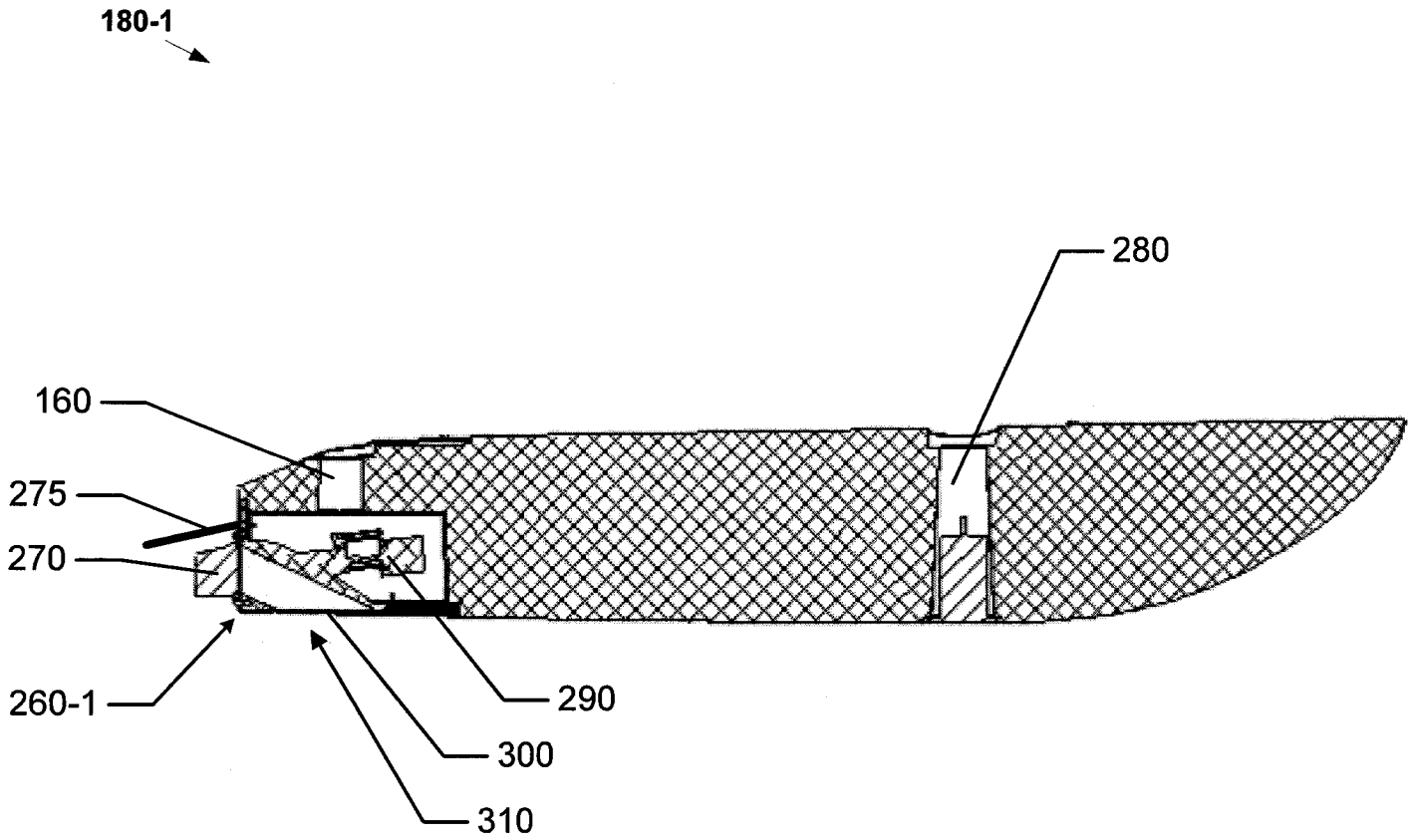
Figure 5:
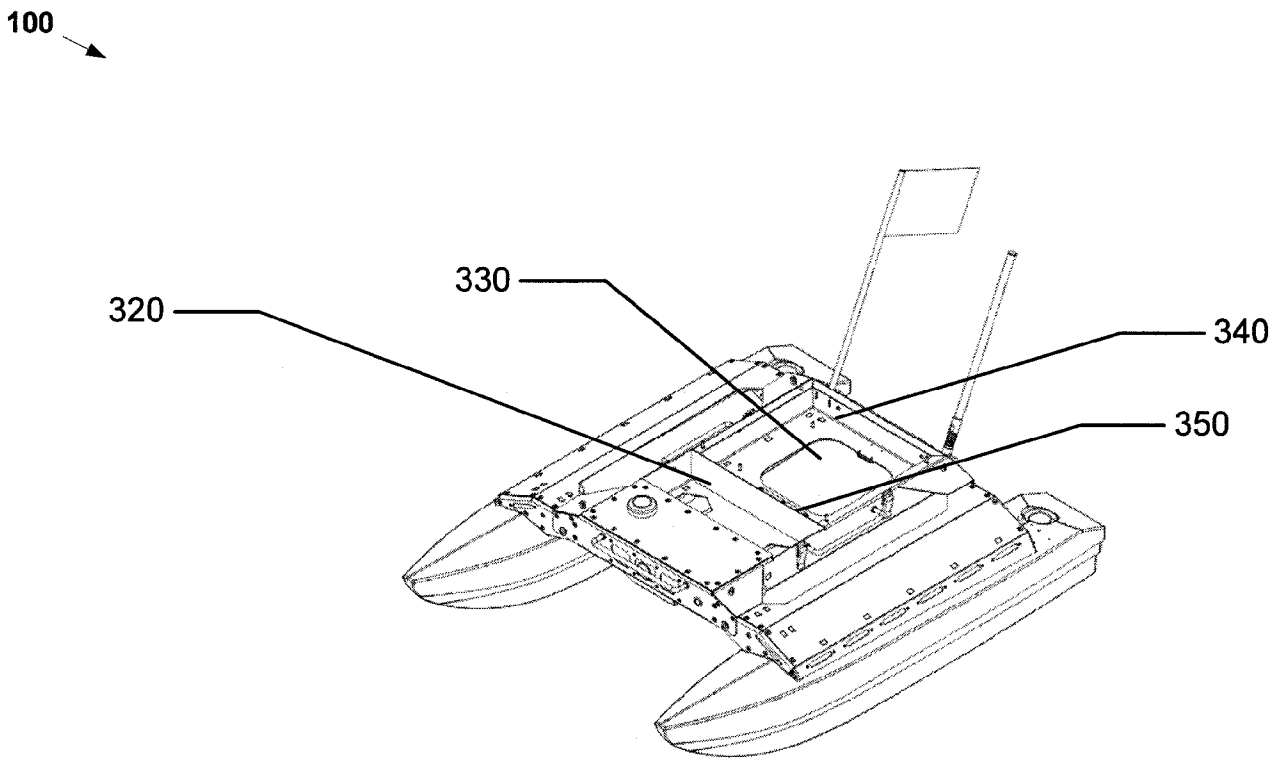
Figure 6:
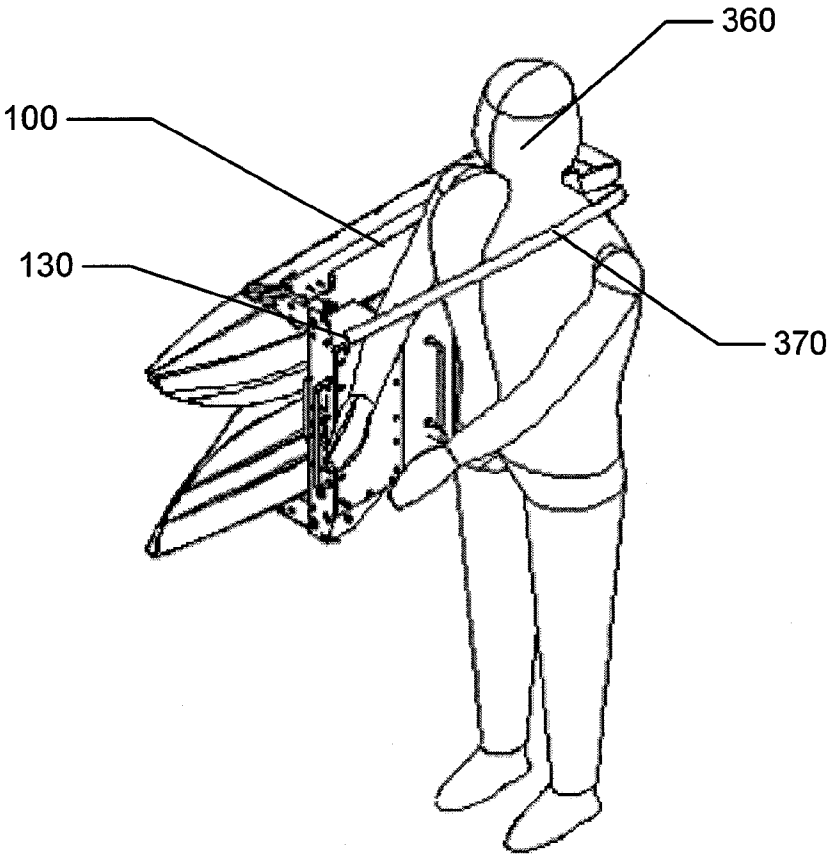
Figure 7:
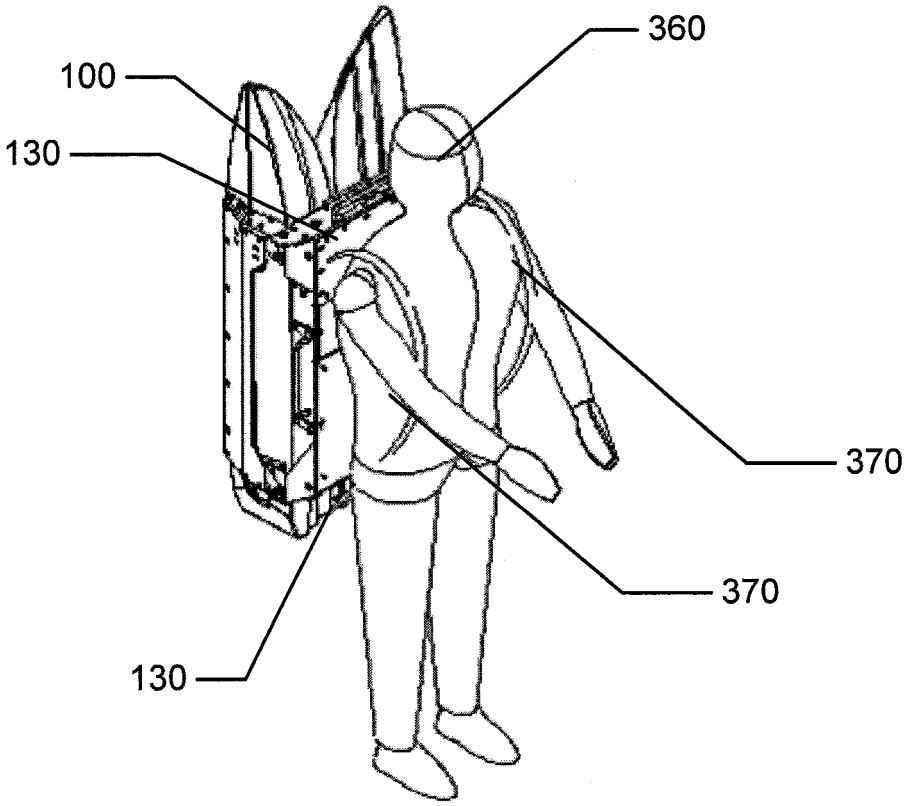
Figure 8:
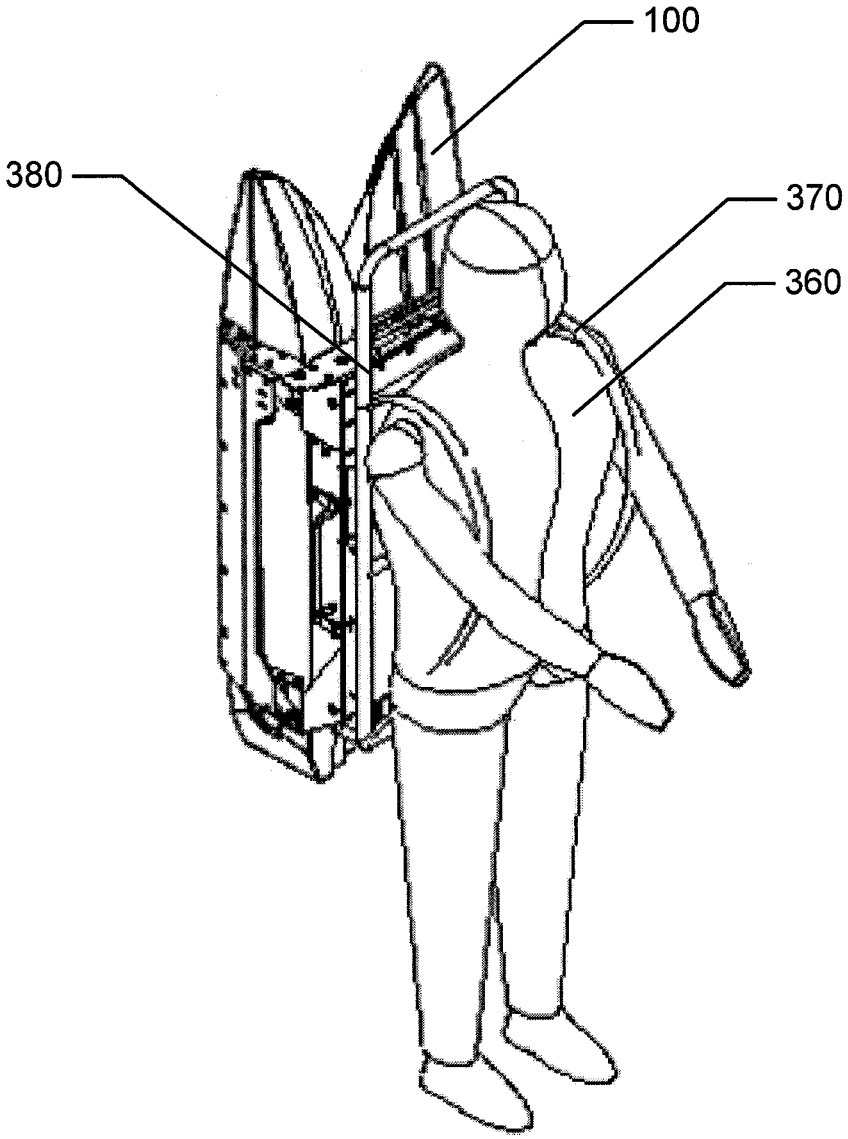
Figure 9:
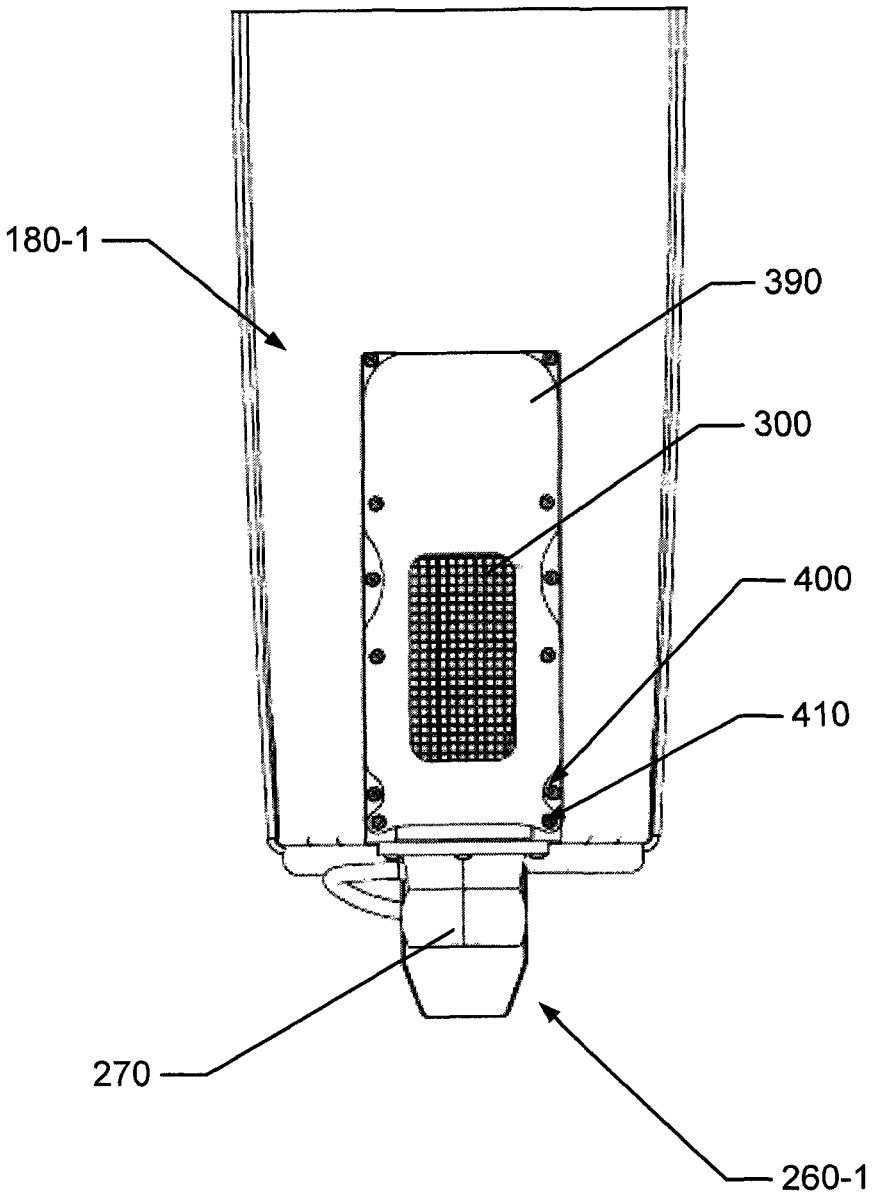

FIGS. 3*a* and 3*b* depict a hull folding process of the water vessel of FIG. 1, according to non-limiting implementations;

FIG. 4 depicts a cross section of a single hull of the water vessel of FIG. 1, according to non-limiting implementations;

FIG. 5 depicts the water vessel of FIG. 1 with the top mounting surface and battery removed, according to non-limiting implementations;

FIG. 6 depicts a method of carrying a water vessel on an operator's shoulder with a strap, according to non-limiting implementations;

FIG. 7 depicts a method of carrying a water vessel on an operator's back with detachable straps, according to non-limiting implementations;

FIG. 8 depicts another method of carrying a water vessel on an operator's back with a detachable frame, according to non-limiting implementations; and FIG. 9 depicts close-up view of a grate coupled to a thruster assembly of a water vessel, according to non-limiting implementations.

DETAILED DESCRIPTION

It is understood that for the purpose of this disclosure, language of "at least one of X, Y, and Z" and "one or more of X, Y and Z" can be construed as X only, Y only, Z only, or any combination of two or more items X, Y, and Z (e.g., XYZ, XYY, YZ, ZZ, and the like).

Herein described is a variable geometry water vessel that can be used for remote surveying, surveillance, or any similar applications. According to some implementations, the described water vessel can be operated in conditions including but not limited to when the water vessel is deployed in shallow water, in the presence of objects which may cause fouling of traditional propulsion systems, in areas where the water vessel needs to be tethered for retrieval and/or deployment, or in situations where the water vessel physical configuration needs to change for transport purposes. The described water vessel is comprised of a framework, also referred to herein as a "frame", onto which is attached a plurality of hulls. The framework is designed such that one or more of these hulls can fold, relative to the frame, to change the size of the water vessel in at least one dimension. Furthermore, according to some implementations, the attachment methods for the hulls to the frame are enabled to prevent the folding process from completing without clear user intent. In other words, the attachment methods may be configured to require an amount of force to be applied in a certain direction before the folding occurs. According to some implementations, the attachment methods comprise a mechanical self-latching mechanism such as is known to those skilled in the art. According to one implementation, the overall dimensions of the water vessel are 1.3×1.0×0.35 m (length×width×height) when the hulls are deployed and 1.3×0.55×0.35 m when the hulls are folded in the stowed configuration.

Each hull incorporates into its design a jet thruster assembly which draws in fluid, such as water, through an intake and expels it through an exhaust such to impart force upon the water vessel. The positioning of the plurality of jet thruster assemblies is such that a thrust differential will exert torque on the water vessel. Since water vessels typically use rudders or vectored thrust methods to steer, using a differential steering method in combination with the distance between the jet thruster assemblies can enable a much tighter turn radius, even without incorporating a rudder or thrust vectoring technique. According to one implementation, the water vessel has a ratio between hull length and thruster separation of ~1:1. Because of the configuration of the jet thruster assemblies, the overall vessel size and performance envelope are designed such that each jet thruster can be electrically driven, and the jet thrusters can be configured to be compact enough to be fit in each hull while maintaining the water vessel's ability to change size.

According to some implementations, the jet thruster assemblies have a grate at one or both of the inlet and outlet to prevent the ingress or intake of objects which may damage the respective jet thruster or impede its ability to produce thrust. According to some implementations, the gratings are configured to minimize pressure loss across them. According to some implementations, using a maximum water vessel speed of 4.0 m/s and an impeller size of 60 mm, it has been found that the optimal grate spacing is in the 0.5 cm range. As in the case of the jet thruster design, according to some implementations, the grates are designed such that they do not impede the folding process.

Optionally, according to some implementations, the jet thruster assemblies may be enabled to reverse thrust via a change in fluid flow direction through the jet thruster, a flow reverser placed in the path of the outlet flow, or other suitable method. Such reversing enables the water vessel to turn in place, which can further enhance the differential steering capabilities. Each jet thruster assembly may also include a set of gratings to prevent items for which they are not designed from being drawn into the intake and damaging the thruster.

The gratings, hull, and exposed features of the jet thruster assemblies can be enabled to prevent rope from being drawn into or caught on aspects of the water vessel, allowing the water vessel to be tethered to shore or another vessel during operation without worry of tangling the tether on features of the water vessel when the water vessel runs over the tether rope. This is advantageous if the water vessel is to be deployed in hazardous environments.

The water vessel may incorporate features to enable easier transport, including attachments for carry straps and tie-down cables. These features can be made accessible in a single physical configuration of the water vessel or multiple physical configurations. An extension of this feature is the combination of the water vessel with a suitably designed backpack or carry bag, which enables the transport of a folded or unfolded water vessel by a single operator or individual.

The water vessel may also incorporate other mounting features for equipment. This may include but is not limited to mechanical mounts on dorsal and ventral surfaces, a through-hull penetration for larger equipment, and modular electrical connection plates to provide power and communication interlinks between the equipment and the water vessel's systems. According to some implementation, there are provided through-hull penetrations enabled to allow equipment to be installed and secured into the dorsal surface of the water vessel and yet be exposed to the water via a hole or holes in the ventral surface.

Equipment such as cameras and Global Positioning System (GPS) antennas may also be incorporated into the water vessel in a more permanent fashion, using a variety of physical mounting and electrical connectivity methods.

The water vessel may be powered by any suitable energy source. According to some implementations, the water vessel is battery-powered. According to some implementations, a nickel-metal-hydride (NiMH) battery is used, and enabled such that a first battery can be easily removed and replaced with a second newly charged battery without requiring any tools.

According to some implementations, the water vessel can be enabled to communicate with other vessels or the shore wirelessly. According to some implementations, the antennae are sized at a minimal height above the water surface as to facilitate the water vessel's ability to navigate under low-hanging foliage. Likewise, the antennae can be configured such that they are sprung at one or more points along the antennae length, mitigating damage due to collision with the surroundings.

The water vessel's jet thruster assemblies and steering systems can be controlled by any system which can provide suitable outputs. According to some implementation, this system may be optionally enabled to use an onboard or off-board state estimation and control system to autonomously or semi-autonomously track abstract control inputs provided by a database, user interface, stored program, or the like. According to some implementations, a state estimation algorithm common to the field is used to combine the vehicle control signals, a mathematical model of vehicle performance, a global positioning system receiver, and an inertial measurement unit into a single estimate of vehicle position, orientation, and velocity. The difference between this estimate and an abstract control input representing a desired vehicle position are then processed via a Proportional-Integral-Derivative Controller (PID) or other algorithm known to those skilled in the art to produce a set of commands for the plurality of jet thrusters which result in the vehicle moving towards the desired vehicle position. Persons skilled in the art will recognize that there are many different, suitable formulations of this problem, including implementing nested control loops, adaptive control algorithms, and gain scheduling.

FIG. 1 depicts a water vessel 100 with a plurality of hulls 180, also referred to herein individually as hull 180-1 and hull 180-2, coupled to vessel frame 230, each one of the plurality of hulls 180 coupled to the vessel frame 230 by folding mechanism 240 (shown in FIG. 2) and configured to move, relative to the vessel frame 230, between a deployed configuration and a stowed configuration in which at least one dimension of the water vessel 100, such as length, width and height, is reduced in respect of the deployed configuration. In the non-limiting implementation depicted in FIG. 1, the plurality of hulls 180 are each connected via hull mounts 190, referred to separately as hull mount 190-1 and hull mount 190-2.

According to some implementations, each one of the plurality of hulls 180 may also incorporate features to support internally mounted equipment. According to some implementations, water vessel 100 includes cable guide 160 to allow power to be provided to internally mounted equipment. However, it is appreciated that any suitable hull design is within the scope of present implementations.

According to some implementations, water vessel 100 may have a carrying mechanism coupled to vessel frame 230 for transporting the water vessel 100 by securing the water vessel 100 to one or more of an operator, another vessel and a vehicle. According to some implementations, the carrying mechanism comprises at least one carrying handle 110. For example, as depicted, the carrying mechanism can comprise more than one carrying handle 110. According to some implementations, the carrying mechanism is permanently attached to water vessel 100. According to some implementations, the carrying mechanism is detachable from water vessel 100. For example, water vessel 100 may have a plurality of attachment points 130 onto which straps or other attachments may be attached temporarily or permanently.

According to some implementations, water vessel 100 comprises at least one signalling device. According to some implementations, water vessel 100 may incorporate active signalling devices such as navigation lights 170 or passive signaling devices such as flags 140. According to some implementations, the at least one signalling device comprises one or more of navigation lights 170 and flags 140.

Water vessel 100 can comprise a variety of onboard and remote systems. According to some implementations, water vessel 100 comprises a communications system. According to some implementations, water vessel comprises a sensing system. According to some implementations, water vessel 100 comprises an onboard control and monitoring system. According to some implementations, the onboard control and monitoring system is configured to provide remote control and monitoring of the water vessel 100.

For example, according to some implementations, water vessel 100 may have a number of sensing, communications, and interfacing hardware incorporated, such as one or more of a power button 200, a communications antenna 150, a camera 210, such as an internally mounted camera, or a GPS antenna 220. According to some implementations, the sensing system comprises one or more of camera 210 and GPS antenna 220.

According to some implementations, water vessel 100 may have a dorsal mounting surface 120 onto which additional equipment can be emplaced. According to some implementations, the dorsal mounting surface 120 is removably coupled to vessel frame 230. According to some implementations, dorsal mounting surface 120 can be secured by any suitable fastening method which may be known to those skilled in the art.

According to some implementations, the water vessel 100 may be powered by a battery 155, which may be enabled to be removable and carried by battery handle 165.

Figure 2:
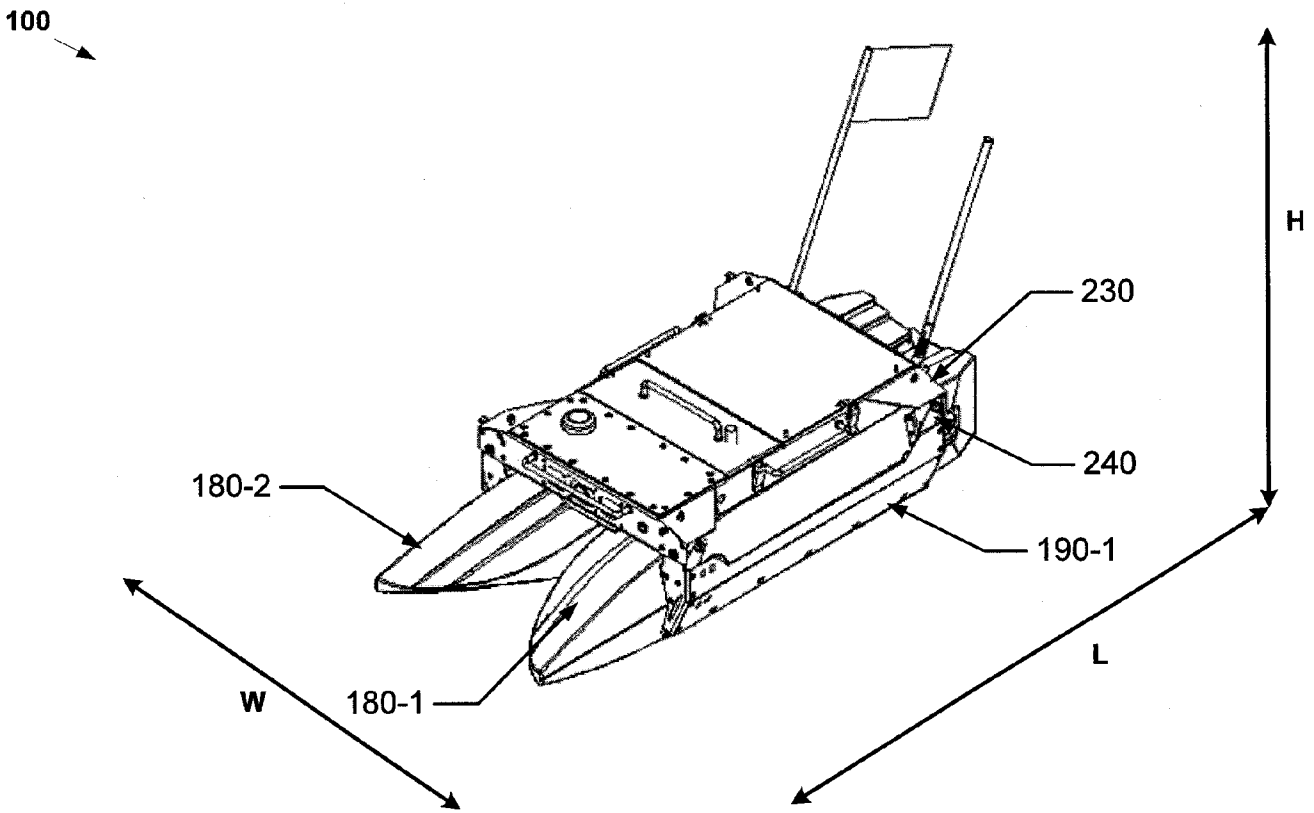
FIG. 2 depicts the water vessel of FIG. 1 with the hulls in a stowed configuration, according to non-limiting implementations.

FIG. 2 depicts a water vessel 100 in a stowed configuration, according to non-limiting implementations, wherein at least one dimension, such as length, height and width, of water vessel 100 has been significantly changed. FIG. 2 is substantially similar to FIG. 1 with like elements having like numbers. Placing water vessel 100 in such a stowed configuration may improve the transportability or storage of the water vessel 100. According to some implementations, the stowed configuration is achieved by rotating at least one of the plurality of hulls 180 relative to vessel frame 230. For example, according to some implementations, the plurality of hulls 180 and hull mounts 190 have been rotated relative to the vessel frame 230.

According to some implementations, each one of the plurality of hulls 180, hull mounts 190 and vessel frame 230 may be coupled together via a folding mechanism 240 which serves to restrict the configuration of the vessel from changing without clear user intent. For example, according to some implementations, clear user intent via the application of force in a specific direction may be required to rotate at least one of the plurality of hulls 180 relative to the vessel frame 230. According to some implementations, the folding mechanism 240 is configured as a pin joint with spring retention to ensure that the configuration is held in either the folded or unfolded configuration.

According to some implementations, the folding mechanism 240 may comprise a spring (such as a mechanical gas-spring), an electrical actuator, a combined electromechanical system, or any other suitable device which is known to those skilled in the art.

It can also be appreciated that the folding mechanism 240, according to some implementations, may be enabled to automatically change the configuration of the water vessel 100 without requiring physical human intervention. For example, according to some implementations, a hydraulic or electric motor may be utilized to rotate at least one of the plurality of hulls 180 relative to the vessel frame 230.

Additional details about the folding process are described in respect of the non-limiting implementation shown in FIGS. 3*a* and 3*b*. FIGS. 3*a* and 3*b* are substantially similar to FIGS. 1 and 2 with like elements having like numbers. In FIG. 3*a*, the water vessel 100 is shown in a deployed configuration, wherein the plurality of hulls 180 are positioned to enhance the stability of the water vessel 100 around the roll axes, "X", of hull 180-1, 180-2 and plurality of thruster assemblies 260 are widely set to help the water vessel 100 to turn. In FIG. 3*b*, the water vessel 100 is shown in a stowed configuration, wherein plurality of hulls 180 are folded together by means of hull mounts 190 rotating relative to water vessel frame 230. In the depicted stowed configuration, the width of the water vessel 100 is significantly reduced, which may ease transport, and the plurality of thruster assemblies 260 are positioned such that their thruster intakes 310 (shown in FIG. 4) are not exposed to the surrounding environment to prevent damage during transport.

The plurality of thruster assemblies 260 are configured to provide thrust to water vessel 100. According to some implementations, the plurality of thruster assemblies 260 are configured to provide differential thrust to water vessel 100. Each one of the plurality of thruster assemblies 260 are coupled to a respective one of the plurality of hulls 180.

FIG. 4 depicts a cross-section of a respective one of plurality of hulls 180, hull 180-1, showing a respective one of the plurality of thruster assemblies 260, thruster assembly 260-1, mounted internally to hull 180-1, the thruster exhaust 270, and the thruster intake 310. FIG. 4 is substantially similar to FIGS. 1 to 3*b* with like elements having like numbers. The thruster intake 310 may be protected by a protective device, such as grate 300, to prevent the intake of foreign objects into the thruster assembly 260-1. It can be appreciated that the plurality of hulls 180 are designed such that they enable water vessel 100 to have a low draught, lacking both a narrow keel and any protrusions below the lowest point on the plurality of hulls 180.

According to some implementations, the plurality of thruster assemblies 260, including thruster assembly 260-1, may be driven by a brushless direct current (DC) motor 290, although those skilled in the art will recognize that a variety of suitable options are available to cause fluid to flow through the plurality of thruster assemblies 260, such as internal combustion engines, magnetohydrodynamic drives, and jet turbines. Hence, according to some implementations, the plurality of thruster assemblies 260 are driven by one or more of a DC motor, an internal combustion engine and a gas turbine. Furthermore, according to some implementations, the plurality of thruster assemblies 260 are configured to provide reverse thrust to water vessel 100. For example, thruster assembly 260-1 may be enabled to reverse the direction of the force it applies to the hull 180-1 by means of reversing the direction of brushless DC motor 290, using reverser buckets, or other suitable methods as known to those skilled in the art.

According to some implementations, plurality of hulls 180 may also incorporate features necessary for providing power to the plurality of thruster assemblies 260 or expelling exhaust from the plurality of thruster assemblies 260. According to some implementations, the brushless DC motor 290 may receive power via cables run through a cable guide 160.

According to some implementations, hull 180-1 may also incorporate hull equipment mounts 280 to allow for additional equipment to be mounted above or below the waterline.

According to some implementations, a diverter plate 275 is coupled to at least one of the plurality of thruster assemblies 260. In the implementation depicted in FIG. 4, diverter plate 275 is coupled to thruster assembly 260-1 via hull 180-1. According to some implementations, diverter plate 275 forces water to transit a longer path to enter the thruster exhaust 270. This prevents air from being drawn into the thruster assembly 260-1 when the thruster assembly 260-1 is operating in reverse, improving system efficiency.

FIG. 5 is another view of FIG. 1 showing a configuration of equipment mount points, according to non-limiting implementations. FIG. 5 is substantially similar to FIGS. 1 to 4 with like elements having like numbers. The dorsal mounting surface 120 is removed and the ventral mounting surface 340 is revealed. A ventral cutout 330 is also depicted which allows for a greater variety of equipment to be mounted. Such equipment can include single-beam sonar, multi-beam sonar, acoustic current profilers, temperature probes, water quality probes, winches, and any other equipment which is known to those skilled in the art. According to some implementations, connection plate 350 is provided to allow equipment to be linked with the power, communication, and control systems of water vessel 100. Also depicted is battery compartment 320 which serves to restrict the motion of a battery 155 should such an energy storage device be utilized.

FIG. 6 depicts a method of carrying water vessel 100, according to non-limiting implementations. FIG. 6 is substantially similar to FIGS. 1 to 5 with like elements having like numbers. In the depicted implementation, a carrying strap 370 is connected to one or more of the attachment points 130 and placed over the shoulder of an operator 360. It is appreciated that the water vessel 100 does not need to be secured to a human, but instead may be tied down to another vessel or vehicle.

FIG. 7 depicts another method of carrying water vessel 100, according to non-limiting implementations. FIG. 7 is substantially similar to FIGS. 1 to 6 with like elements having like numbers. In the depicted implementation, a plurality of carrying straps 370 are secured to attachment points 130 and carried on the back of an operator 360.

FIG. 8 depicts another method of carrying water vessel 100, according to non-limiting implementations. FIG. 8 is substantially similar to FIGS. 1 to 7 with like elements having like numbers. In the depicted implementation, water vessel 100 is secured to a carrying frame 380. The carrying frame 380 can, for example, be carried on the back of an operator 360 via one or more carrying straps 370.

Hence, according to some implementations, the carrying mechanism comprises one or more of a carrying strap 370, a carrying frame 380 and a carrying handle 110.

FIG. 9 depicts a close-up view of grate 300 coupled to thruster assembly 260-1, according to non-limiting implementations, and how grate 300 can be integrated into hull 180-1. FIG. 9 is substantially similar to FIGS. 1 to 8 with like elements having like numbers. In the depicted implementation, grate 300 is held in place by a retaining plate 390 which is secured into the thruster assembly 260-1 via plate fasteners 410. Also depicted is the thruster exhaust 270 and additional thruster assembly fasteners 400. The additional thruster assembly fasteners 400 serve to secure the thruster assembly 260 to the hull 180. The features of grate 300 may be configured to minimize pressure loss at a specified fluid flow rate and density, while maximizing the ability of grate 300 to prevent foreign matter from flowing into the thruster intake. For example, according to some implementations, grate 300 uses a 0.5 cm square pitch when configured for a top vessel speed of 4 m/s and payload of 10 kg.

The described water vessel is a variable geometry watercraft which can assume different configurations for transport or operation. The described water vessel can also be configured as a variable geometry, low-draught watercraft in order to operate in shallow water conditions. According to some implementations, the water vessel can be folded up and carried easily by one person. The water vessel includes integrated jet thrusters for motive power and steering, and can have protective devices mounted to or around the jet thrusters to prevent environmental fouling. Resistance to fouling and lack of exposed propellers result in a system which can be tethered to shore or other vessels for retrieval. The described water vessel is suited for use as an unmanned surface craft and may be remotely or autonomously controlled in such a configuration. Additional equipment can be mounted to both the ventral and dorsal surface of the water vessel, and the water vessel can provide power and communication functionality to this additional equipment. The water vessel can incorporate a number of onboard monitoring systems into its design such as global positioning sensors and monitoring cameras.

While the foregoing written description enables one of ordinary skill to make and use what is considered presently to be the best mode thereof, those of ordinary skill will understand and appreciate the existence of variations, combinations, and equivalents of the specific implementation, method, and examples herein. The present specification should therefore not be limited by the above described implementation, method, and examples, but by all implementations and methods within the scope and spirit of the claims appended hereto.

What is claimed is:

1. A water vessel comprising:

a frame;

a plurality of hulls coupled to the frame, each one of the plurality of hulls coupled to the frame by a folding mechanism and configured to move, relative to the frame, between a deployed configuration and a stowed configuration in which at least one dimension of the water vessel is reduced in respect of the deployed configuration;

a plurality of thruster assemblies configured to provide thrust to the water vessel, each one of the plurality of thruster assemblies being coupled to a respective one of the plurality of hulls, each of the plurality of thruster assemblies removably coupled to a respective one of the plurality of hulls using one or more fasteners; and a protective device removably coupled to a respective one of the plurality of thruster assemblies, the protective device for preventing intake of foreign objects into the respective one of the plurality of thruster assemblies, the protective device removably coupled to the respective one of the plurality of thruster assemblies using one or more additional fasteners.

2. The water vessel of claim 1 further comprising a carrying mechanism coupled to the frame for transporting the water vessel by securing the water vessel to the one or more of an operator, another vessel and a vehicle.

3. The water vessel of claim 2, wherein the carrying mechanism comprises one or more of a carrying strap, a carrying frame and a carrying handle.

4. The water vessel of claim 2, wherein the carrying mechanism is detachable.

5. The water vessel of claim 1, wherein the plurality of thruster assemblies are configured to provide differential thrust to the water vessel.

6. The water vessel of claim 1, wherein the folding mechanism is configured to rotate at least one of the plurality of hulls relative to the frame.

7. The water vessel of claim 1, wherein the folding mechanism comprises one or more of: a spring, an electrical actuator and a combined electromechanical system.

8. The water vessel of claim 1, wherein the protective device comprises a grate.

9. The water vessel of claim 1, wherein the plurality of thruster assemblies are configured to provide reverse thrust to the water vessel.

10. The water vessel of claim 9 further comprising a diverter plate coupled to at least one of the plurality of thruster assemblies.

11. The water vessel of claim 1, wherein the plurality of thruster assemblies are driven by one or more of: a direct current (DC) motor, an internal combustion engine and a gas turbine.

12. The water vessel of claim 1 further comprising an onboard control and monitoring system.

13. The water vessel of claim 12, wherein the onboard control and monitoring system is configured to provide remote control and monitoring of the water vessel.

14. The water vessel of claim 1 further comprising a communications system.

15. The water vessel of claim 1 further comprising one or more of: a power button, a communications antenna, a camera and a Global Positioning System (GPS).

16. The water vessel of claim 1 further comprising at least one signalling device.

17. The water vessel of claim 16, wherein the at least one signalling device comprises one or more of: a navigation light and a flag.

18. The water vessel of claim 1 further comprising a sensing system having one or more of a camera and a Global Positioning System (GPS).

19. The water vessel of claim 1, wherein the water vessel is battery-powered.

20. The water vessel of claim 1 further comprising a dorsal mounting surface removably coupled to the frame.

* * * * *